US008177859B2

(12) United States Patent
Schmidt et al.

(10) Patent No.: US 8,177,859 B2
(45) Date of Patent: May 15, 2012

(54) METHOD OF FLAMEPROOFING CELLULOSE FIBERS

(75) Inventors: Manfred Schmidt, Gelnhausen (DE); Stephanie Schauhoff, Langen (DE); Frank Gähr, Esslingen (DE)

(73) Assignee: Evonik Degussa GmbH, Essen (DE)

( * ) Notice: Subject to any disclaimer, the term of this patent is extended or adjusted under 35 U.S.C. 154(b) by 1767 days.

(21) Appl. No.: 10/494,581

(22) PCT Filed: Sep. 20, 2002

(86) PCT No.: PCT/EP02/10567

§ 371 (c)(1), (2), (4) Date: May 6, 2004

(87) PCT Pub. No.: WO03/040460

PCT Pub. Date: May 15, 2003

(65) Prior Publication Data

US 2005/0011015 A1 Jan. 20, 2005

(30) Foreign Application Priority Data

Nov. 9, 2001 (DE) ..... 101 55 066

(51) Int. Cl.
*D06M 13/322* (2006.01)
*D06M 11/38* (2006.01)
*C09K 21/00* (2006.01)

(52) U.S. Cl. ..... 8/181; 8/125; 252/608; 442/136

(58) Field of Classification Search ..... 260/249.6, 260/249.8, 249.5; 8/125, 181, 537
See application file for complete search history.

(56) References Cited

U.S. PATENT DOCUMENTS

| | | | | |
|---|---|---|---|---|
| 1,886,480 | A | 11/1932 | Haller et al. | |
| 2,025,660 | A | 12/1935 | Haller et al. | 260/101 |
| 3,521,995 | A * | 7/1970 | Smith | 8/183 |
| 3,755,323 | A * | 8/1973 | Weil et al. | 544/195 |
| 3,956,243 | A * | 5/1976 | Loss et al. | 528/244 |
| 4,315,859 | A * | 2/1982 | Nikles | 540/598 |
| 2002/0037410 | A1 | 3/2002 | Criegee et al. | 428/393 |

FOREIGN PATENT DOCUMENTS

| | | |
|---|---|---|
| CH | 370 384 | 10/1959 |
| DE | 100 38 100 | 2/2002 |
| EP | 0 616 071 | 9/1994 |

OTHER PUBLICATIONS

International Search Report for international application PCT/EP02/10567, 2002.
International Preliminary Examination Report for international application PCT/EP02/10567, 2003.
English language abstract for EP 0 616 071, Reference B1 above, 1994.
English language abstract for de 100 38 100, Reference B2 above, 2002.
English language translation for CH 370 384, Reference B3 above, 1959.

* cited by examiner

*Primary Examiner* — Peter F Godenschwager
(74) *Attorney, Agent, or Firm* — Law Office of: Michael A. Sanzo, LLC

(57) ABSTRACT

The present invention is directed to methods for flameproofing cellulose fibres and articles containing these fibres. The method involves treatment of materials with cyanuric chloride.

9 Claims, No Drawings

METHOD OF FLAMEPROOFING CELLULOSE FIBERS

CROSS REFERENCE TO RELATED APPLICATIONS

The present application represents U.S. national stage of international application PCT/EP02/10567, which had an international filing date of Sep. 20, 2002 and which was published in German under PCT Article 21(2) on May 15, 2003. The international application claims priority to German application 101 55 066.9, filed on Nov. 9, 2001.

FIELD OF THE INVENTION

The invention relates to a method of flameproofing cellulose fibres and articles containing them (cellulose fibre materials). In particular, the invention comprises treating the cellulose fibres or the articles containing them with a cyanuric chloride derivative in aqueous phase. The invention is further directed towards cellulose fibres, and articles containing them, which have been rendered flame-retardant in accordance with the invention, and the particular uses thereof. Mention is also made of the use according to the invention of a particular liquor.

BACKGROUND OF THE INVENTION

For the flameproofing of cellulose fibres, which are to be understood as being especially cotton fibres, regenerated cellulose fibres, such as, for example, viscose, solution-spun cellulose fibre products, such as, for example, lyocell, and of textiles containing them, such as protective clothing, children's clothing, curtains, carpets and upholstery, methods of permanent, i.e. wash-resistant, and non-permanent proofing are known. Flameproofing that is not resistant to washing is based especially on inorganic salts, such as ammonium hydrogen phosphate, ammonium sulfate, borax and boric acid, which may optionally additionally be combined with organic nitrogen bases. In the case of permanent flameproofing, a distinction can be made between (I) addition of a flameproofing additive to an appropriate polymer melt or polymer spinning solution, II) application of a reactive flameproofing component to the fibre material or textile material in the form of a finishing process.

In order to achieve permanent flameproofing effects according to (I), antimony-halogen compounds, organic phosphorus compounds and nitrogen-sulfur-containing additives are used.

In the case of proofing according to (II), phosphorus and phosphorus/nitrogen flameproofing agents are predominantly used, which agents are either applied directly to the fibres or are applied in the form of a monomer or a preliminary condensation product and cured on the fibres in the form of a polymer. For example, preliminary condensation products of tetrakishydroxymethylphosphonium chloride and urea are applied to the fibres, following which treatment with ammonia and then with hydrogen peroxide is carried out—see Melliand Textilberichte 3/1990, 219-224. This and similar processes are technically complicated and, moreover, result in a product having a relatively stiff feel. The use of dialkylphosphono-carboxylic acid amides and melamine resins on cotton likewise enables good flameproofing to be achieved, but it leads to a relatively great loss in fastness to rubbing.

Further disadvantages of the known flameproofing carried out in the form of a finishing process are high emissions in the waste air and waste water. The fixing of dialkylphosphono-carboxylic acid amide-melamine flameproofing agents, for example, is carried out at approximately 140° C. for several minutes in a tenter frame in a textile finishing plant. Under such conditions, high emissions of in some cases potentially toxic compounds, such as, for example, formaldehyde or organophosphorus compounds, are formed. It is estimated that more than half of the dialkylphosphono-carboxylic acid amide is not fixed to the cellulosic fibre material and passes into the waste water in a subsequent washing process. It is to be expected that the development which is under way of appropriately validated analytical processes for determining flameproofing agents and cleavage products in waste air and waste water will result in severe cuts and restrictive measures on the part of the legislator with regard to the application of the known flameproofing agents.

DE10038100.6 describes a method using particular cyanuric chloride derivatives. A disadvantage of that method is that the cyanuric chloride derivatives described therein can only be applied to the fibres with difficulty in aqueous solutions, so that in particular they are not very suitable for application of the flameproofing compound by means of a pad within the context of a continuous procedure, as is conventional in the textile industry.

SUMMARY OF THE INVENTION

The object of the present invention is, therefore, to provide a method of flameproofing using cyanuric chloride derivatives which does not exhibit the disadvantages of the prior-known processes; in particular, the proofing should allow a permanent reduction in the emissions of toxic compounds when applied under economically and ecologically acceptable conditions. According to a further object, it should be possible to carry out the method in as simple a manner as possible using the existing and conventional devices of a cellulose or textile plant, the high costs of an ammonia evaporation unit in particular are to be avoided. Finally, it is also to be possible by means of the method to obtain cellulose fibres, or articles containing them, which have been rendered flame-retardant or self-extinguishing and which have a LOI value (limiting oxygen index according to ASTM 02863-77) of 24 or 27 and above, without the resistance to tearing being markedly affected.

DETAILED DESCRIPTION OF THE INVENTION

A method for the permanent flameproofing of cellulose fibres and articles containing them has been found, which method comprises treating the cellulose fibres, or an article containing them, with cyanuric chloride derivatives in aqueous-alkaline phase, cyanuric chloride derivatives having a water solubility of >3 g/100 ml (20° C.) being used. The water solubility of the cyanuric chloride derivatives used is of great advantage with regard to the yields of the reaction and the reproducibility of the proofing effects. It is accordingly possible to apply aqueous solutions of the cyanuric chloride derivatives over a prolonged period, continuously and with a high degree of constancy, for example by means of a pad or a slop pad (Béla von Falkai: "Synthesefasern" Verlag Chemie, 1981, p. 285), to the cellulose fibre material that is to be proofed.

In the case of the proofing in question, the following procedure is preferably followed:

a) swelling of the cellulose fibres or of an article containing them is carried out under the action of lye, b) the lye is removed by pressing or is washed out, c) the reaction with a cyanuric chloride derivative is completed.

Swelling of the cellulose fibre material according to a) makes it possible to obtain much higher degrees of substitution in the reaction of the cellulose with the cyanuric chloride derivatives added under c) than is possible without previous swelling in lye. Surprisingly, a large part of the lye can be washed out with water before the substitution reaction, without this being accompanied, provided the readily water-soluble cyanuric chloride derivatives are used according to the invention, by a serious fall in the degrees of substitution that are to be achieved. According to a preferred embodiment of the method, more than 80% of the swelling lye from step a) has been washed out following step b). Suitable washing liquids are protic solvents, especially water. It is also possible to use other protic solvents, however, depending on the field of use, such as, for example, alcohols, especially methanol or ethanol. The washing out of a large part of the swelling lye also brings advantages with regard to the re-use of the lye. The term "lye" is understood as meaning especially so-called mercerising lye, which is used in many textile plants for mercerisation and is generally an approximately 20% sodium hydroxide solution.

The choice of cyanuric chloride derivatives which can be used in accordance with the invention is guided not only by their ready water solubility but also by the fact that as many nitrogen atoms and, optionally, phosphorus atoms as possible can be firmly applied to the cellulose fibre material by means of molecules of low molar mass. In detail, there are suitable particular cyanuric chloride derivatives of the general formula (I)

(I)

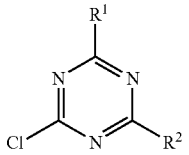

in which $R^1$ may represent $C^1$, $R^2$ $R^2$ may represent OX, $SO_3X$, $SO_2X$, $OSO_3X$, $OSO_2X$, $OPO_3X$, $OPO_2X$, $NH_2$—$(CH_2)_n$—COOH (n=1-3), NH—$(CH_2)_n$—OH (n=1-3), N(—$(CH_2)_n$—OH)$_2$, (n=1-3), wherein X=$H^+$, $Li^+$, $Na^+$, $K^+$, ½$Mg^{++}$, ½$Ca^{++}$, in a method of permanently flameproofing cellulose fibres and articles containing them, comprising treating the cellulose fibres, or an article containing them, with those derivatives in aqueous-alkaline phase.

The use of monohydroxydichlorotriazine (NHDT) for the mentioned purpose is most particularly preferred.

In principle, the concrete method can be applied to all cellulose fibres, yarns, nonwovens, or flat articles containing them, that come into consideration to the person skilled in the art for that purpose. The cellulose fibres to be modified according to the invention are advantageously a cotton fibre or viscose fibre. However, it is also possible to use wood cellulose or cotton linters, for example, it being possible in particular for regenerated cellulose fibres or lyocell fibres to be modified in that manner. Further starting products for the modification reaction according to the invention are fibre flocks or yarns containing cellulose.

The person skilled in the art can choose the amount of cyanuric chloride derivative to be used, based on the amount of cellulose per proofing operation, as desired. In so doing, he will aim for the best possible flameproofing with the lowest possible amount, because that represents the most economical procedure. The cyanuric chloride derivatives are preferably used in an amount, based on the cellulose, from 3 to 200 wt. %, especially from 6 to 50 wt. % and more preferably from 8 to 33 wt. %.

The amount should preferably be sufficient that, within an economically expedient period of time, cyanuric chloride derivative is present on the fibres in an amount corresponding to a subsequent nitrogen content of at least 1.0 wt. %, especially from 1.5 to 12 wt. %, more preferably from 2 to 8 wt. %, based on the proofed cellulose.

The proofing process claimed according to the invention is generally followed by further-processing and finishing processes, with special mention being made in this connection of the reaction of the modified cellulose fibre material, for example obtained according to procedure a) to c), with phosphorus-containing compounds in order to achieve good flameproofing effects. The quality of the flameproofing depends on the one hand on the components having flameproofing action and on the other hand on the amount used, based on the weight of the fibres. Nitrogen-containing compounds and phosphorus-containing compounds have a flameproofing effect. The simultaneous presence of nitrogen and phosphorus has a particularly advantageous effect with regard to increasing the LOI (synergism). The LOI value is a measure of the quality of the flameproofing (according to ASTM D2'863-77). The LOI indicates the limiting value of the volume fraction of oxygen in an oxygen/nitrogen gas mixture in which a flat textile structure still burns from top to bottom. The higher the LOI value, the better the flameproofing effect. At a LOI of 24 and above, a material is said to have flame-retardant properties, and at values of 27 and above, it is said to have self-extinguishing properties. The cyanuric chloride derivatives used according to the invention for flameproofing allow the nitrogen content of the cellulose provided with the cyanuric chloride derivative to be adjusted to values which, with addition of suitable phosphorus-containing compounds, give rise to a flameproofing effect that is in accordance with requirements, or even to self-extinguishing properties.

It is possible for the modified cellulose fibres, or articles containing them, obtained, for example, according to procedure a) to c) to be treated with a phosphorus-containing flameproofing agent before or after the proofing according to the invention or alternatively simultaneously therewith, it being possible for the phosphorus-containing flameproofing agent to enclose the cellulose fibre material in the form of a polycondensation product or, preferably, to react reactively with the cellulose fibre material. Expediently, the phosphorus-containing compound—as an alternative, of course, several different phosphorus-containing compounds may be used—is used in such an amount that the proofed cellulose fibre material has a phosphorus content of at least 0.6 wt. %, preferably at least 1 wt. %.

There may be used as the phosphorus-containing compound in this connection the ammonium salt of a phosphorous acid alkyl ester, preferably phosphorous acid dimethyl ester. That salt is obtainable in a simple manner from dimethyl phosphite and ammonia and accordingly is very inexpensive, which is particularly advantageous. The modified cellulose fibres, or articles containing them, obtained, for example, according to a) to c), can be impregnated with the phosphorus-containing compounds by means of a pad, and the compounds can subsequently be fixed, optionally by means of dry heat.

According to a preferred embodiment, a cellulose fibre material modified, for example, according to processes a) to c) is impregnated by means of a pad with a solution containing the phosphorus-containing agent and is fixed by means of dry heat, for example in a tenter frame. The LOI values can be further increased, as compared with the cellulose fibre material simply modified according to the invention, by fixing of the phosphorus-containing compound.

However, it is also possible to apply known flameproofing agents from the group of the dialkylphosphonocarboxylic acid amides, phosphonic acid esters and/or tetrakishydroxymethylphosphonium salts, and it may be considered a substantial advantage of the proofing step claimed according to the invention that, for fixing such flameproofing agents to the modified cellulose fibre material, no crosslinking substances, such as, for example, methylolmelamine, must be added in order to obtain permanent proofing effects, because that reduces the quality of the materials.

In a further embodiment, the invention is concerned also with cellulose fibres, or articles containing them, produced by the method according to the invention. The cellulose fibres, or articles containing them, preferably have a nitrogen content of 1.0 wt. %, especially from 1.5 to 12 wt. %, more preferably from 2 to 8 wt. %. Also preferably, the cellulose fibres, or articles containing them, according to the invention are those having a LOI value of at least 22, especially >25.

The LOI of the cellulose fibre material, especially fabric, obtained, for example, according to procedures a) to c) is dependent on the nature of the cyanuric chloride derivative used in step c) and on the degree of substitution established in dependence on the reaction procedure, especially the resulting nitrogen content, which can be determined by elemental analysis.

The treatment according to the invention can be carried out at room temperature or at elevated temperature, preferably above 100° C. The usual treatment times at room temperature are from 30 minutes to 24 hours, for fibres especially from 30 minutes to 1 hour, preferably from 40 minutes to 50 minutes, most preferably approximately 45 minutes, and for flat structures especially from 1 hour to 12 hours, most preferably from 2 hours to 6 hours. In the case of treatment with hot air above 100° C., preferably >110° C., more preferably >120° C., very preferably >125° C. and most preferably >130° C., especially at approximately >140° C., more preferably at 150° C., the treatment times are from 1 minute to 10 minutes, in any case less than 20 minutes. Alternatively, the treatment may also be carried out in a saturated steam atmosphere at approximately >100° C., preferably >101° C., most preferably at 102° C., or in a hot steam atmosphere at approximately 125° C., preferably at 127° C. and most preferably at 130° C. or above, the times being the same as those indicated for hot-air treatment.

The nitrogen content of the modified cellulose fibre material obtained, for example, according to procedure a) to c) results mainly from the heterocyclically bonded nitrogen of the triazine ring, because the nitrogen content for an unmodified cellulose fibre material is very low (from 0.0 to 0.2%). By means of the modification according to the invention, for example according to procedure a) to c), nitrogen contents of from 0.5 to >10 wt. % can be obtained, in dependence on the substrate and the reaction procedure. Normal nitrogen values for a modified cellulose fibre material vary between 1.0 and 2.0 wt. %, resulting in LOI values of 19 and 22. By comparison, an unmodified cotton fabric has a LOI of from 16 to 17. LOI values of >25 can be obtained according to the invention.

A further invention relates to the use of a liquor containing cyanuric chloride derivatives having a water solubility of >3 g/100 ml (20° C.), or containing the above-mentioned cyanuric chloride derivatives, for the permanent flameproofing of cellulose fibres.

The cellulose fibre material so proofed is preferably used in the production of protective clothing, children's clothing, curtains, interior fittings for motor vehicles, carpets or upholstery.

The cellulose fibres obtained by the method according to the invention, and articles containing them, such as yarns, nonwovens and flat articles, are characterised in that they contain S-triazine compounds bonded to glucose units of the cellulose by way of ether bridges. The cyanuric chloride to be used can be brought into contact with the cellulose fibre material in the presence or absence of conventional textile auxiliaries, with special mention being made of surface-active compounds (surfactants), dispersing agents, mercerising auxiliaries and sequestering agents. After the modification of the cellulose fibres, for example according to processes a) to c), non-reactively-bonded cyanuric chloride derivative and excess alkali are washed out with water, preferably boiling water.

The modified fabrics to be obtained by the method claimed according to the invention can be finished by the processes conventional in the textiles industry, non-continuously by beam, jigger or hank treatment (e.g. in a jigger or jet) or continuously by the pad batch, pad steam, pad cure and/or pad dry process (Béla von Falkai: "Synthesefasern" Verlag Chemie, 1981, p. 283-289).

It has proved particularly advantageous that the tinctorial properties of the modified cellulose fibre materials, especially with regard to dyeing with substantive and reactive dyes, are not substantially different in comparison with the unmodified starting fabric. That concerns especially the depths of colour which are to be achieved, the rate of absorption of the dyes and the levelness of the dyeing.

Of course, cellulose fibre materials rendered flame-retardant according to the invention can be converted into yarns and textile articles with other fibres (such as, for example, polyester, polyamide, polyacrylonitrile and aramid fibres), which may have been rendered flame-retardant in a completely different manner.

The method claimed according to the invention exhibits considerable advantages over the prior art mentioned at the beginning. The proofing steps are simple to carry out in the textile industry within the context of a continuous operation or in the cellulose industry in a batch reactor. The toxicological disadvantages of the flameproofing methods established on the market do not arise. Pollution of the waste air and of the waste water with ecologically harmful emissions is largely avoided. The cyanuric chloride derivatives to be used are readily obtainable and, while having a low molar mass, they have at the same time a high nitrogen content, which is necessary for flameproofing action. The method can be applied to many cellulosic substrates. The flameproofing action can easily be adjusted in dependence on the amount used, and combination with phosphorus-containing flameproofing compounds is additionally possible, it also being possible for phosphorus and nitrogen to be combined with one another in the same agent. A LOI value of over 24 can be achieved without difficulty. A further advantage is that the resistance to tearing is reduced only minimally and, at the same time, the crease resistance increases. The tinctorial properties are affected only slightly by the modification.

The term "flameproofing" is understood to mean that the proofed cellulose fibres and an article containing them are less readily flammable and/or are extinguished more rapidly after removal of an ignition source than is the case with non-proofed fibres, or articles containing them.

Further details and advantages of the method will become apparent from the following Examples.

The term "aqueous-alkaline" is understood to mean, in particular, an aqueous medium, which may optionally contain other water-soluble organic solvents, which has a pH value of >7, preferably >8, particularly preferably >9 and most particularly preferably >10.

EXAMPLES

Example 1

A strip of cotton fabric (16 g, desized, bleached, 191 g/m$^2$) is swollen in 500 ml of sodium hydroxide solution (250 g/l) at room temperature for 3 minutes. The fabric is then squeezed to a residual moisture content of 80%. The strip is treated in a padding machine with a 10% aqueous solution of monohydroxydichlorotriazine (NHDT) (moisture absorption 44%), wound onto a round metal body, sealed air-tight with a polyethylene film and left for 24 hours at room temperature and with slight rotation of the metal body. The process accordingly corresponds to the semi-continuous short-dwell padding process conventional in the textile industry (lit: Béla von Falkai: "Synthesefasern" Verlag Chemie, 1981, p. 288). During the dwell time, the cyanuric chloride derivative is fixed on the cellulose material. The strip is then unwound, and NHDT which has not been fixed, and hydrolysis products, are washed out with boiling water in a 5 liter beaker.

A nitrogen content of the modified fabric of 1.95% is obtained; the LOI of the fabric is 20.6. The untreated cotton fabric has a LOI of 17.

Example 2

A strip of cotton fabric (16 g, desized, bleached, 191 g/m$^2$) is treated in 500 ml of a dilute sodium hydroxide solution (25 g/l) at room temperature for 3 minutes. Only imperceptible swelling occurs. The further procedure is then as in Example 1. The nitrogen content is determined as 0.51%. The LOI of the fabric modified according to Example 2 is 18.3.

Example 3

In a continuous procedure, sodium hydroxide solution (250 g/l) is applied, with the aid of a double pad, to a strip (50 cm wide, 20 m long) of cotton fabric (desized, bleached, 191 g/m$^2$) and mercerisation is carried out for 2 minutes with controlled transverse tension. The lye is washed out, likewise with transverse tension of the fabric, the residual content of alkali, based on caustic soda, being determined by titration as 11%, based on the amount of caustic soda applied. The fabric material is pressed between two metal rolls (residual moisture content approximately 75%) and is treated, immediately and continuously, in the moist state, by means of a pad, with a 10% aqueous solution of NHDT, an additional moisture absorption of 51% being determined. The strip of fabric is wound up and wrapped in a film analogously to Example 1, placed on a winding body and left for 24 hours at room temperature. It is then washed with boiling water and dried.

The nitrogen content of the modified fabric is determined by elemental analysis as 1.78%. The LOI of the fabric modified according to Example 3 is 20.2.

Example 4

A procedure analogous to Example 3 is followed, but the fabric, following the pad treatment with aqueous NHDT solution, is immediately and continuously passed through a tenter frame in order to carry out the fixing of the NHDT under hot air. Treatment parameters in the tenter frame: 150° C., 2 minutes. The fabric is washed and dried analogously to Example 1 and 2.

The nitrogen content of the modified fabric is determined by elemental analysis as 1.65%. The LOI of the fabric modified according to Example 2 is 20.0.

Example 5

The cotton fabrics proofed according to Examples 1, 3 and 4 are subjected to reactive dyeing with C.I. Reactive Black 5 by the extraction process.

Dyeing Parameters:

Bath ratio: 1:20

Dye concentration: 5%

Glauber salt: 50 g/l

Dyeing temperature: 70° C.

Rate of heating: 1.5° C.

Alkali addition: 30 min. after reaching the dyeing temperature: 15 g/l of soda and 1.5 ml/l of 32.5 wt. % sodium hydroxide solution Dyeing time from alkali addition: 60 min.

The K/S values were determined by colorimetry at 450 nm as the parameter for the depth of the dyeings.

TABLE 1

K/S values for reactive dyeing with C.I. Reactive Black 5 on proofed fabric according to Examples 1 to 3 in comparison with non-proofed cotton fabric

| Fabric type/ Example no. | Starting fabric non-proofed | Ex. 1 | Ex. 2 | Ex. 3 | Ex. 4 |
|---|---|---|---|---|---|
| K/S (450 nm) | 6.80 | 6.68 | 5.60 | 6.18 | 6.32 |

Example 6

132 ml of dimethyl phosphite are added, with cooling, to 1 litre of 25% aqueous ammonia solution. When the evolution of gas has ceased, the solution is left at room temperature for a further 2 hours, and the water is then removed in a rotary evaporator until crystallisation occurs. The resulting white solid is recrystallised from ethanol/acetone (1:4). Yield: 66% of theory; melting point: 110° C. corresponding to the literature. Using that phosphorous acid monomethyl ester ammonium salt (ammonium monomethyl phosphite), there is prepared an aqueous solution which contains in 5 parts of water 1 part of the phosphorous acid monomethyl ester ammonium salt. A pH of 3.5 is established by the dropwise addition of phosphoric acid. The solution is applied by means of a pad to a cotton fabric proofed according to Example 3, and excess solution is squeezed out by means of two metal rolls (moisture applied: 92%). The fabric material is pre-dried for a short time (about 1 to a maximum of 2 minutes) at 70° C., cut into 3 parts and treated in a drying oven, the treatment temperature being varied. The parameters set and the LOI value obtained after washing of the fabric are shown in Table 2.

TABLE 2

| LOI values of cotton fabric proofed according to the method and after fixing of ammonium monomethyl phosphite (variable fixing conditions) | | |
|---|---|---|
| Temperature/time | P content [%] | LOI |
| 130° C./5 min. | 2.1 | 27.1 |
| 140° C./5 min. | 2.3 | 28.0 |
| 150° C./5 min. | 2.8 | 30.5 |

Example 7

A cotton fabric (8 g) proofed according to Example 3 is impregnated with a mixture of 60 g of a dialkylphosphonocarboxylic acid amide solution (commercial product Aflammit® KWB, Thor-Chemie), 3.5 g of phosphoric acid and 40 ml of water. The strip of fabric is squeezed to a residual moisture content of 80% and dried at 100° C. in a laboratory dryer for 1 minute. The strip of fabric is rinsed alkaline-hot and then several times cold.

A phosphorus content of 3.3% and a LOI of 31.7 are achieved. The resistance to washing is equally as good as that of a fabric which has not been proofed beforehand, in the case of which the proofing bath contains a crosslinking agent.

Example 8

In a 2 liter glass beaker, 50 g of cotton linters (average degree of polymerisation 1400) are swollen for 5 minutes, with constant stirring, using a sodium hydroxide solution having a concentration of 250 g/l and cooled to 10° C. The fibre product is pressed. The moist fibre product is introduced into a 2 litre round-bottomed flask, which has been filled with 1.2 liters of a 10% aqueous solution of NHDT, and then stirred thoroughly at room temperature for 30 minutes. Filtration is carried out, and the fibrous reaction product is washed several times with boiling water and dried. The nitrogen content of the modified cellulose fibre material is determined by elemental analysis as 6.6%.

What is claimed is:

1. A method of permanently flameproofing cellulose fibres or an article containing said cellulose fibres, comprising:

a) swelling said cellulose fibres in lye;

b) removing said lye;

c) subsequent to steb b) treating the moist cellulose fibres with a cyanuric chloride derivative in aqueous-alkaline phase, wherein said cyanuric chloride derivative is a compound of the general formula (I)

(I)

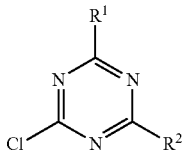

wherein:

$R^1$ is selected from the group consisting of: Cl; OX; $SO_3X$; $SO_2X$; $OSO_3X$; $OSO_2X$;

$OPO_3X$; $OPO_2X$; $NH_2$—$(CH_2)_n$—COOH (n=1-3); NH—$(CH_2)_n$—OH (n=1-3); N(—$(CH_2)_n$—OH)$_2$, (n=1-3); and wherein X is selected from the group consisting of: $H^+$; $Li^+$; $Na^+$; $K^+$;

½$Mg^{++}$; and ½$Ca^{++}$; and $R^2$ is selected from the group consisting of: OX; $SO_3X$; $SO_2X$; $OSO_3X$; $OSO_2X$; $OPO_3X$;

$OPO_2X$; $NH_2$—$(CH_2)_n$—COOH (n=1-3); NH—$(CH_2)_n$—OH (n=1-3); N(—$(CH_2)_n$—OH)$_2$, (n=1-3); and wherein X is selected from the group consisting of: $H^+$; $Li^+$; $Na^+$; $K^+$; ½$Mg^{++}$; and ½$Ca^{++}$ wherein said cyanuric chloride derivative is used in an amount sufficient to produce a subsequent nitrogen content of at least 2 to 8 wt. %, based on the flameproofed cellulose.

2. The method of claim 1, wherein:

$R^1$ is selected from the group consisting of: Cl; OX; $SO_3X$; $SO_2X$; $OSO_3X$; $OSO_2X$;

$OPO_3X$; $OPO_2X$; wherein X is selected from the group consisting of: $H^+$; $Li^+$; $Na^+$;

$K^+$; ½$Mg^{++}$; and ½$Ca^{++}$; and $R^2$ is selected from the group consisiting of: OX; $SO_3X$; $SO_2X$; $OSO_3X$; $OSO_2X$;

$OPO_3X$; $OPO_2X$; and wherein X is selected from the group consisting of: $H^+$; $Li^+$;

$Na^+$; $K^+$; ½$Mg^{++}$; ½$Ca^{++}$.

3. The method of claim 1, wherein said cyanuric chloride derivative is the sodium salt monohydroxydichlorotriazine (NHDT).

4. The method of any one of claim 1, 2 or 3, wherein said cellulose fibres are selected from the group consisting of: cotton fibres, regenerated cellulose fibres, cellulose derivative fibres and lyocell fibres.

5. The method of any one of claim 1, 2 or 3, wherein said cyanuric chloride derivative is used in an amount from 3 to 200 wt. %, based on cellulose.

6. The method of any one of claim 1, 2 or 3, further comprising:

d) after the treatment of step c) drying said fibers; wherein the entire process is carried out at a temperature of at least room temperature and no greater than 150° C.

7. The method of any one of claim 1, 2 or 3, further comprising treating said cellulose fibres or said article containing said cellulose fibres with a phosphorus-containing compound before or after flameproofing.

8. The method of claim 7, wherein said cellulose fibres or said article containing said cellulose fibres are impregnated with said phosphorus-containing compound using a pad, and said phosphorus-containing compound is then fixed.

9. The method of claim 8, wherein said phosphorus-containing compound is fixed using dry heat.

* * * * *